US012446617B2

(12) United States Patent
Bagheri et al.

(10) Patent No.: US 12,446,617 B2
(45) Date of Patent: Oct. 21, 2025

(54) VAPORIZER DEVICE INCLUDING ORGANIC BIFUNCTIONAL WICK-HEATER ASSEMBLY

(71) Applicant: JUUL Labs, Inc., San Francisco, CA (US)

(72) Inventors: Samira Bagheri, Mountain View, CA (US); Namhey Lee, Hayward, CA (US)

(73) Assignee: JUUL Labs, Inc., Washington, DC (US)

( * ) Notice: Subject to any disclaimer, the term of this patent is extended or adjusted under 35 U.S.C. 154(b) by 723 days.

(21) Appl. No.: 17/859,069

(22) Filed: Jul. 7, 2022

(65) Prior Publication Data

US 2022/0330608 A1 Oct. 20, 2022

Related U.S. Application Data

(63) Continuation of application No. PCT/US2021/012606, filed on Jan. 8, 2021.

(60) Provisional application No. 62/959,493, filed on Jan. 10, 2020.

(51) Int. Cl.
*A24F 40/10* (2020.01)
*A24F 40/42* (2020.01)

(52) U.S. Cl.
CPC ..... *A24F 40/10* (2020.01); *A24F 40/42* (2020.01)

(58) Field of Classification Search
CPC ..... A24F 40/10; A24F 40/42; A24F 40/44
See application file for complete search history.

(56) References Cited

U.S. PATENT DOCUMENTS

| | | | | |
|---|---|---|---|---|
| 6,123,935 | A * | 9/2000 | Wefler | A01M 1/2077 239/45 |
| 8,375,957 | B2 | 2/2013 | Hon | |
| 8,833,364 | B2 | 9/2014 | Buchberger | |
| 9,763,478 | B2 | 9/2017 | Cameron et al. | |
| 9,770,055 | B2 | 9/2017 | Cameron et al. | |
| 9,888,723 | B2 | 2/2018 | Cameron et al. | |
| 9,980,514 | B2 | 5/2018 | Malamud et al. | |
| 10,039,323 | B2 | 8/2018 | Schuler et al. | |
| 10,058,128 | B2 | 8/2018 | Cameron et al. | |
| 10,085,486 | B2 | 10/2018 | Cameron | |
| 10,206,429 | B2 | 2/2019 | Davis et al. | |
| 10,292,427 | B2 | 5/2019 | Cameron et al. | |
| 10,470,499 | B2 | 11/2019 | Clemens et al. | |

(Continued)

FOREIGN PATENT DOCUMENTS

| | | |
|---|---|---|
| CN | 109222235 A | 1/2019 |
| CN | 109619655 A | 4/2019 |

(Continued)

*Primary Examiner* — Woody A Lee, Jr.
(74) *Attorney, Agent, or Firm* — Mintz Levin Cohn Ferris Glovsky and Popeo, P.C.

(57) ABSTRACT

A vaporization device includes a cartridge having a reservoir that holds a vaporizable material, a heating element, and a wicking element that can draw the vaporizable material to the heating element to be vaporized. The vaporizer cartridge is configured for coupling to a vaporizer device body and containing a vaporizable material. Various embodiments of the vaporizer cartridge are described that include an organic bifunctional wick-heater assembly using porous organic-based material. Related systems, methods, and articles of manufacture are also described.

23 Claims, 5 Drawing Sheets

(56) References Cited

U.S. PATENT DOCUMENTS 10,512,282 B2 12/2019 Bowen et al.
10,564,655 B2 2/2020 Blackley
10,791,767 B2 10/2020 Novak, III et al.
10,856,577 B2 12/2020 Smith et al.
10,859,459 B2 12/2020 Sur
10,932,490 B2 3/2021 Hejazi
10,939,702 B2 3/2021 Novak, III et al.
11,053,395 B2 7/2021 Karles et al.
11,119,083 B2 9/2021 Smith et al.
11,191,306 B2 12/2021 Smith et al.
11,259,569 B2 3/2022 Hejazi
11,291,249 B2 4/2022 Aller et al.
11,583,004 B2 * 2/2023 Fraser ..... H05B 3/44
2009/0324206 A1 12/2009 Young et al.
2014/0286630 A1 * 9/2014 Buchberger ..... A61M 11/041 392/395
2015/0090279 A1 4/2015 Chen
2015/0090280 A1 4/2015 Chen
2015/0136158 A1 5/2015 Stevens et al.
2015/0217068 A1 8/2015 Wakalopulos
2016/0150828 A1 6/2016 Goldstein et al.
2016/0324217 A1 11/2016 Cameron
2016/0325055 A1 11/2016 Cameron
2016/0331022 A1 11/2016 Cameron
2016/0331023 A1 11/2016 Cameron
2016/0331024 A1 11/2016 Cameron
2016/0331025 A1 11/2016 Cameron
2016/0331026 A1 11/2016 Cameron
2016/0331027 A1 11/2016 Cameron
2016/0331034 A1 11/2016 Cameron
2016/0331859 A1 11/2016 Cameron
2016/0334119 A1 11/2016 Cameron
2016/0334847 A1 11/2016 Cameron
2016/0337141 A1 11/2016 Cameron
2016/0337362 A1 11/2016 Cameron
2016/0337444 A1 11/2016 Cameron
2016/0356751 A1 12/2016 Blackley
2016/0363570 A1 12/2016 Blackley
2016/0363917 A1 12/2016 Blackley
2016/0367925 A1 12/2016 Blackley
2016/0370335 A1 12/2016 Blackley
2017/0018000 A1 1/2017 Cameron
2017/0020188 A1 1/2017 Cameron
2017/0020195 A1 1/2017 Cameron
2017/0020196 A1 1/2017 Cameron
2017/0020197 A1 1/2017 Cameron
2017/0027229 A1 2/2017 Cameron
2017/0035110 A1 * 2/2017 Keen ..... A24F 40/44
2017/0042230 A1 2/2017 Cameron
2017/0042231 A1 2/2017 Cameron
2017/0046357 A1 2/2017 Cameron
2017/0046738 A1 2/2017 Cameron
2017/0055588 A1 3/2017 Cameron
2017/0086496 A1 3/2017 Cameron
2017/0086497 A1 3/2017 Cameron
2017/0086503 A1 3/2017 Cameron
2017/0086504 A1 3/2017 Cameron
2017/0091853 A1 3/2017 Cameron
2017/0092106 A1 3/2017 Cameron
2017/0093960 A1 3/2017 Cameron
2017/0093981 A1 3/2017 Cameron
2017/0095005 A1 * 4/2017 Monsees ..... A24F 40/46
2017/0119058 A1 5/2017 Cameron
2017/0135407 A1 5/2017 Cameron
2017/0135408 A1 5/2017 Cameron
2017/0135409 A1 5/2017 Cameron
2017/0135411 A1 5/2017 Cameron
2017/0135412 A1 5/2017 Cameron
2017/0136193 A1 5/2017 Cameron
2017/0136194 A1 5/2017 Cameron
2017/0136301 A1 5/2017 Cameron
2017/0181474 A1 6/2017 Cameron
2017/0181475 A1 6/2017 Cameron
2017/0185364 A1 6/2017 Cameron
2017/0215478 A1 8/2017 Harrison et al.
2017/0265517 A1 9/2017 Swede et al.
2017/0303590 A1 10/2017 Cameron et al.
2017/0303593 A1 10/2017 Cameron et al.
2017/0303594 A1 10/2017 Cameron et al.
2017/0309091 A1 10/2017 Cameron et al.
2017/0332702 A1 11/2017 Cameron et al.
2019/0001077 A1 1/2019 Xu et al.
2019/0124982 A1 5/2019 Atkins et al.
2019/0208824 A1 7/2019 Wright
2020/0046025 A1 2/2020 Otiaba et al.
2021/0120877 A1 * 4/2021 Bailey ..... A24B 15/165
2021/0274846 A1 * 9/2021 Potter ..... A24F 40/485
2021/0345681 A1 11/2021 Cameron
2022/0183355 A1 * 6/2022 Phillips ..... A24F 40/44

FOREIGN PATENT DOCUMENTS

DE 102017123870 A1 4/2019
EP 3574775 A1 12/2019
EP 3599914 B1 11/2021
EP 3937690 B1 6/2023
WO WO-2015112750 A1 7/2015
WO WO-2016122417 A1 8/2016
WO WO-2017025383 A1 2/2017
WO WO-2018208078 A2 11/2018
WO WO-2019038522 A1 2/2019
WO WO-2020002924 A1 1/2020
WO WO-2021127168 A1 6/2021

* cited by examiner

VAPORIZER DEVICE INCLUDING ORGANIC BIFUNCTIONAL WICK-HEATER ASSEMBLY

CROSS REFERENCE TO RELATED APPLICATIONS

This application is a continuation of International Patent Application No. PCT/US2021/012606 entitled "Vaporizer Device Including Organic Bifunctional Wick-Heater Assembly," with an International Filing Date of Jan. 8, 2021, which claims priority to U.S. Provisional Patent Application No. 62/959,493 entitled "Vaporizer Device Including Organic Bifunctional Wick-Heater Assembly." filed Jan. 10, 2020, each of which is hereby incorporated by reference in its entirety and for all purposes.

TECHNICAL FIELD

The subject matter described herein relates to vaporizer devices and cartridges for use with vaporizer devices, including cartridges and vaporizer devices having a bifunctional wick-heater assembly including a porous organic substrate.

BACKGROUND

Vaporizer devices, which can also be referred to as vaporizers, electronic vaporizer devices, or e-vaporizer devices, can be used for delivery of an aerosol (e.g., vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that may be used to simulate the experience of smoking, but without burning of tobacco or other substances. Vaporizers are gaining increasing popularity both for prescriptive medical use, in delivering medicaments, and for consumption of tobacco, nicotine, and other plant-based materials. Vaporizer devices may be portable, self-contained, and/or convenient for use.

In use of a vaporizer device, the user inhales an aerosol, colloquially referred to as "vapor," which may be generated by a heating element that vaporizes (e.g., causes a liquid or solid to at least partially transition to the gas phase) a vaporizable material, which may be liquid, a solution, a solid, a paste, a wax, and/or any other form compatible for use with a specific vaporizer device. The vaporizable material used with a vaporizer can be provided within a cartridge (e.g., a separable part of the vaporizer device that contains vaporizable material) that includes an outlet (e.g., a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (e.g., conductive, convective, and/or radiative) causes heating of a vaporizable material to produce a mixture of air and vaporized material to form a vapor for inhalation of the vaporizable material by a user of the vaporization device.

In some implementations, the vaporizable material can be drawn out of a reservoir and into the vaporization chamber via a wicking element (e.g., a wick). Drawing of the vaporizable material into the vaporization chamber may be at least partially due to capillary action provided by the wick as the wick pulls the vaporizable material along the wick in the direction of the vaporization chamber.

Vaporizer devices can be controlled by one or more controllers, electronic circuits (e.g., sensors, heating elements), and/or the like on the vaporizer. Vaporizer devices may also wirelessly communicate with an external controller (e.g., a computing device such as a smartphone).

SUMMARY

In certain aspects of the current subject matter, challenges associated with heating and/or wicking of vaporizable material may be addressed by inclusion of one or more of the features described herein or comparable/equivalent approaches as would be understood by one of ordinary skill in the art. Aspects of the current subject matter relate to bifunctional wick-heater assemblies including a porous organic substrate, for use in a vaporizer device or a cartridge for use in a vaporizer device.

In an aspect, a cartridge for a vaporizer device is provided. The cartridge includes a reservoir configured to contain a vaporizable material and an atomizer configured to vaporize the vaporizable material. The atomizer includes a porous organic substrate configured to draw the vaporizable material from the reservoir. The porous organic substrate is further configured to receive an electrical current to vaporize the vaporizable material.

In another interrelated aspect, a device is provided, the device including a receptacle configured to receive a cartridge as described and illustrated herein, including embodiments.

In another interrelated aspect, a system is provided. The system includes a device, and the device includes a receptacle configured to receive a cartridge as described and illustrated herein, including embodiments.

In some variations, one or more of the following features may optionally be included in any feasible combination.

The cartridge can further include a condensation chamber in fluid communication with the atomizer and configured to generate an aerosol from the vaporizable material. The cartridge can further include a mouthpiece configured to deliver the aerosol to a user. The cartridge can further include a first bus bar and a second bus bar, such that the first bus bar is disposed at a first end of the porous organic substrate and the second bus bar is disposed at a second end of the porous organic substrate. The first bus bar can include a first cartridge contract and the second bus bar can include a second cartridge contact. The porous organic substrate can include an air channel disposed therethrough to provide air to the condensation chamber.

The cartridge can include an air channel disposed proximate to the porous organic substrate. The cartridge can further include a first air inlet in fluid communication with the atomizer. The first air inlet can be configured to deliver air to the atomizer. The cartridge can further include a second air inlet in fluid communication with the atomizer.

The second air inlet can be configured to deliver air to the atomizer. The cartridge can further include a cannula in fluid communication with the atomizer and the condensation chamber to deliver the vaporizable material from the atomizer to the condensation chamber.

The porous organic substrate can include a graphene material. The porous organic substrate can further include a polymer. The polymer can be polymethylmethacrylate. The porous organic substrate can include a graphene and polymer aerogel. The porous organic substrate can include a plurality of fluid channels configured to provide fluid flow of the vaporizable material. The porous organic substrate can have an average pore size diameter from about 5 microns to about 50 microns. The porous organic substrate can have an average pore size diameter from about 10 microns to about 40 microns. The porous organic substrate can have an average pore size diameter from about 10 microns to about 30 microns. The porous organic substrate can have an average pore size diameter from about 10 microns to about 20 microns. The porous organic substrate can a resistivity of about 0.5 to about 2.0 ohm-cm. The porous organic substrate can include a surface treatment.

The cartridge can further include the vaporizable material. The vaporizable material can include a nicotine formulation. The vaporizable material can include a humectant including propylene glycol, vegetable glycerin, or combinations thereof. The vaporizable material can include a nicotine salt formulation.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1A:
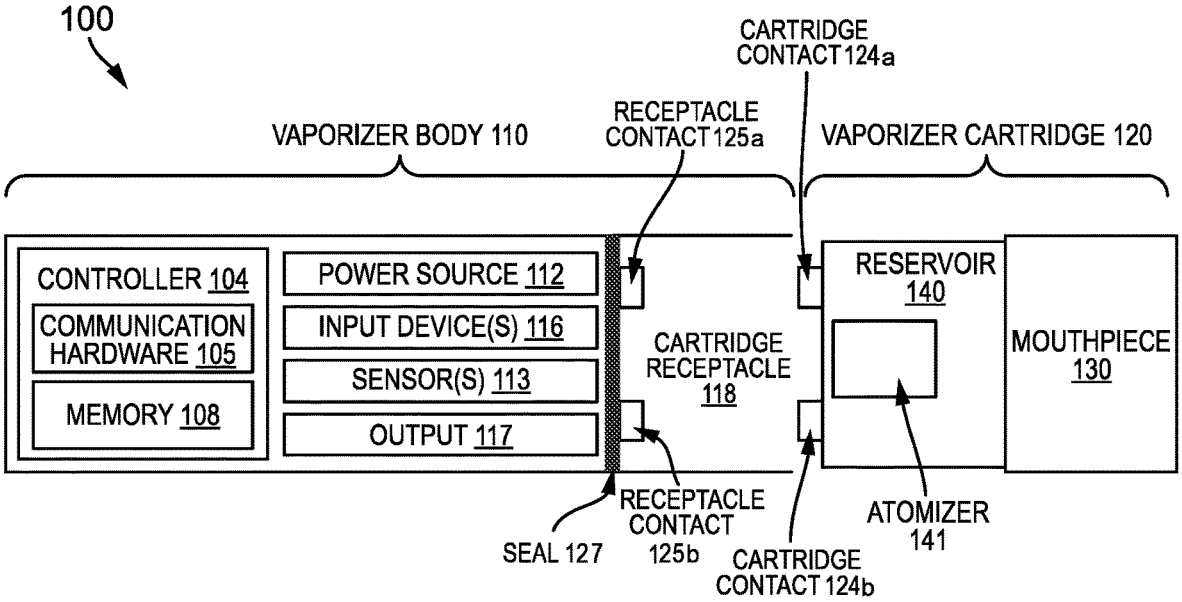
FIG. 1A is a block diagram of a vaporizer.

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (e.g., a vaporizer body that includes a battery and other hardware, and a cartridge that includes a vaporizable material), and/or the like. A "vaporizer system," as used herein, may include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (e.g., by convection, conduction, radiation, and/or some combination thereof) a vaporizable material to provide an inhalable dose of the material.

The vaporizable material used with a vaporizer device may be provided within a cartridge (e.g., a part of the vaporizer that contains the vaporizable material in a reservoir or other container) which may be refillable when empty, or disposable such that a new cartridge containing additional vaporizable material of a same or different type can be used). A vaporizer device may be a cartridge-using vaporizer device, a cartridge-less vaporizer device, or a multi-use vaporizer device capable of use with or without a cartridge. For example, a vaporizer device may include a heating chamber (e.g., an oven or other region in which material is heated by a heating element) configured to receive a vaporizable material directly into the heating chamber, and/or a reservoir or the like for containing the vaporizable material. In some implementations, a vaporizer device may be configured for use with a liquid vaporizable material (e.g., a carrier solution in which an active and/or inactive ingredient (s) are suspended or held in solution, or a liquid form of the vaporizable material itself), a paste, a wax, and/or a solid vaporizable material. A solid vaporizable material may include a plant material that emits some part of the plant material as the vaporizable material (e.g., such that some part of the plant material remains as waste after the material is vaporized for inhalation by a user) or optionally can be a solid form of the vaporizable material itself, such that all of the solid material may eventually be vaporized for inhalation. A liquid vaporizable material may likewise be capable of being completely vaporized, or may include some portion of the liquid material that remains after all of the material suitable for inhalation has been vaporized. In some embodiments, the liquid vaporizable material can include a nicotine formulation, a nicotine salt formulation, a humectant such as propylene glycol or vegetable glycerin, or combinations thereof.

Described herein are various cartridge embodiments that are time and resource efficient to manufacture and package, as well as result in minimal harm to the environment (e.g., reduce or eliminate plastics and packaging waste). For example, some cartridge embodiments described herein include a porous material, such as a porous organic substrate (e.g., porous graphene-based material), that is saturated with a vaporizable material. The porous organic substrate can include a plurality of fluid channels having a capillary pressure that can assist with controlling fluid flow of the vaporizable material. For example, the capillary pressure can cause the vaporizable material to travel into the porous organic substrate (e.g., during filling and/or manufacturing of the cartridge). Additionally, the capillary pressure provided by the porous organic substrate can cause the vaporizable material to remain contained within the porous organic substrate, as well as allow the vaporizable material to exit the cartridge (e.g., for vaporization and inhalation by a user), as will be described in detail below. As such, the porous organic substrate can act as a reservoir for containing the vaporizable material, as well as act as a wick or fluid filling/dispensing mechanism. Cartridges including such porous organic substrate can thus include less parts and be more easily manufactured at least compared to cartridges including separate features for achieving vaporizable material containment (e.g., reservoir) and flow control (e.g., wick). By reducing parts and simplifying manufacturing, cost and waste associated with the cartridge can be reduced. Other benefits are within the scope of this disclosure.

Various embodiments of vaporizers for use with the cartridges including porous organic substrate are also described herein. In some embodiments, the vaporizers include a receptacle for releasably coupling the cartridge. Embodiments of the vaporizer device also include a heating element that is configured to vaporize liquid vaporizable material dispensed from the cartridge to form an inhalable aerosol. In some embodiments, the heating element is configured to directly contact the porous organic substrate containing vaporizable material to thereby heat and/or vaporize the vaporizable material. In some embodiments, the heating element is configured to heat airflow prior to entering a vaporization chamber, which is in fluid communication with the porous organic substrate containing the vaporizable material, to thereby heat and/or vaporize the vaporizable material. Other features and configurations associated with the vaporizer device and cartridge are described in greater detail below.

Referring to the block diagram of FIG. 1A, a vaporizer device 100 can include a power source 112 (e.g., a battery, which may be a rechargeable battery), and a controller 104 (e.g., a processor, circuitry, etc. capable of executing logic) for controlling delivery of heat to an atomizer 141 to cause a vaporizable material 102 to be converted from a condensed form (e.g., a solid, a liquid, a solution, a suspension, a part of an at least partially unprocessed plant material, etc.) to the gas phase. The controller 104 may be part of one or more printed circuit boards (PCBs) consistent with certain implementations of the current subject matter. After conversion of the vaporizable material 102 to the gas phase, at least some of the gas-phase vaporizable material 102 may condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the gas-phase or aerosol-phase vaporizable material 102 with other air streams, which. may affect one or more physical parameters of an aerosol. In some vaporizer devices, and particularly for vaporizer devices configured for delivery of volatile vaporizable materials, the inhalable dose may exist predominantly in the gas phase (e.g., formation of condensed phase particles may be very limited).

Vaporizer devices 100 for use with liquid vaporizable materials 102 (e.g., neat liquids, suspensions, solutions, mixtures, etc.) can include an atomizer 141 in which a wicking element (e.g., a wick) conveys an amount of a liquid vaporizable material 102 to a part of the atomizer 141 that includes a heating element (not shown in FIG. 1A). The wicking element may be configured to draw liquid vaporizable material 102 from a reservoir 140 configured to contain the liquid vaporizable material 102, such that the liquid vaporizable material 102 may be vaporized by heat delivered from a heating element. The wicking element may also optionally allow air to enter the reservoir 140 and replace the volume of liquid removed. In some implementations of the current subject matter, capillary action may pull liquid vaporizable material 102 into the wick for vaporization by the heating element, and air may return to the reservoir 140 through the wick to at least partially equalize pressure in the reservoir 140. Other methods of allowing air back into the reservoir 140 to equalize pressure are also within the scope of the current subject matter.

As used herein, the terms "wick" or "wicking element" include any material capable of causing fluid motion via capillary pressure.

The heating element may include one or more of a conductive heater, a radiative heater, and/or a convective heater. One type of heating element is a resistive heating element, which may comprise a material (e.g., a metal or alloy, for example a nickel-chromium alloy, or a non-metallic resistor) configured to dissipate electrical power in the form of heat when electrical current is passed through one or more resistive segments of the heating element. In some implementations of the current subject matter, an atomizer 141 can include a heating element which includes a resistive coil or other heating element wrapped around, positioned within, integrated into a bulk shape of, pressed into thermal contact with, or otherwise arranged to deliver heat to a wicking element, to cause a liquid vaporizable material 102 drawn from a reservoir 140 by the wicking element to be vaporized for subsequent inhalation by a user in a gas and/or a condensed (e.g., aerosol particles or droplets) phase. Other wicking elements, heating elements, and/or atomizer assembly configurations are also possible.

Certain vaporizer devices may, additionally or alternatively, be configured to create an inhalable dose of gas-phase and/or aerosol-phase vaporizable material 102 via heating of a non-liquid vaporizable material 102, such as a solid-phase vaporizable material 102 (e.g., a wax or the like) or plant material (e.g., tobacco leaves and/or parts of tobacco leaves). In such vaporizer devices, a resistive heating element may be part of, or otherwise incorporated into or in thermal contact with, the walls of an oven or other heating chamber into which the non-liquid vaporizable material 102 is placed. Alternatively, a resistive heating element or elements may be used to heat air passing through or past the non-liquid vaporizable material 102, to cause convective heating of the non-liquid vaporizable material 102. In still other examples, a resistive heating element or elements may be disposed in intimate contact with plant material such that direct conductive heating of the plant material occurs from within a mass of the plant material, as opposed to only by conduction inward from walls of an oven.

The heating element may be activated in association with a user puffing (e.g., drawing, inhaling, etc.) on a mouthpiece 130 of the vaporizer device 100 to cause air to flow from an air inlet, along an airflow path that passes an atomizer 141 (e.g., wicking element and heating element). Optionally, air may flow from an air inlet through one or more condensation areas or chambers, to an air outlet in the mouthpiece 130. Incoming air moving along the airflow path moves over or through the atomizer 141, where gas-phase vaporizable material 102 is entrained into the air. The heating element may be activated via a controller 104, which may optionally be a part of a vaporizer body 110 as discussed herein, causing current to pass from the power source 112 through a circuit including the resistive heating element, which is optionally part of a vaporizer cartridge 120 as discussed herein. As noted herein, the entrained gas-phase vaporizable material 102 may condense as it passes through the remainder of the airflow path such that an inhalable dose of the vaporizable material 102 in an aerosol form can be delivered from the air outlet (e.g., of a mouthpiece 130) for inhalation by a user.

Activation of the heating element may be caused by automatic detection of the puff based on one or more signals generated by one or more sensors 113. These sensors 113 and signals may include one or more of: a pressure sensor or sensors disposed to detect pressure along the airflow path relative to ambient pressure (or optionally to measure changes in absolute pressure), one or more motion sensors (e.g., an accelerometer) of the vaporizer device 100, one or more flow sensors of the vaporizer device 100, a capacitive lip sensor of the vaporizer device 100, detection of interaction of a user via one or more input devices 116 (e.g., buttons or other tactile control devices of the vaporizer device 100), receipt of signals from a computing device in communication with the vaporizer device 100, and/or via other approaches for determining that a puff is occurring or imminent.

As discussed herein, a vaporizer device 100 consistent with implementations of the current subject matter may be configured to connect (e.g., wirelessly or via a wired connection) to a computing device (or optionally two or more devices) in communication with the vaporizer device 100. To this end, the controller 104 may include communication hardware 105. The controller 104 may also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system may include a general-purpose computing device (e.g., a smartphone, a tablet, a personal computer, some other portable device such as a smartwatch, or the like) that executes software to produce a user interface for enabling a user to interact with a vaporizer device 100. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the resistive heating element, or in other examples of coupling of a computing device with a vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to an operating temperature for creation of an inhalable dose of vapor/aerosol. Other functions of the vaporizer device 100 may be controlled by interaction of a user with a user interface on a computing device in communication with the vaporizer device 100.

The temperature of a resistive heating element of a vaporizer device 100 may depend on a number of factors, including an amount of electrical power delivered to the resistive heating element and/or a duty cycle at which the electrical power is delivered, conductive heat transfer to other parts of the electronic vaporizer device 100 and/or to the environment, latent heat losses due to vaporization of a vaporizable material 102 from the wicking element and/or the atomizer 141 as a whole, and convective heat losses due to airflow (e.g., air moving across the heating element or the atomizer 141 as a whole when a user inhales on the vaporizer device 100). As noted herein, to reliably activate the heating element or heat the heating element to a desired temperature, a vaporizer device 100 may, in some implementations of the current subject matter, make use of signals from a sensor 113 (e.g. a pressure sensor) to determine when a user is inhaling. The sensor 113 can be positioned in the airflow path and/or can be connected (e.g., by a passageway or other path) to an airflow path containing an inlet for air to enter the vaporizer device 100 and an outlet via which the user inhales the resulting vapor and/or aerosol such that the sensor 113 experiences changes (e.g. pressure changes) concurrently with air passing through the vaporizer device 100 from the air inlet to the air outlet. In some implementations of the current subject matter, the heating element may be activated in association with a user's puff, for example by automatic detection of the puff, or by the sensor 113 detecting a change (e.g. a pressure change) in the airflow path.

The sensor(s) 113 can be positioned on or coupled to (e.g., electrically or electronically connected, either physically or via a wireless connection) the controller 104 (e.g., a printed circuit board assembly or other type of circuit board). To take measurements accurately and maintain durability of the vaporizer device 100, it can be beneficial to provide a resilient seal 150 to separate an airflow path from other parts of the vaporizer device 100. The seal 150, which can be a gasket, may be configured to at least partially surround the sensor(s) 113 such that connections of the sensor(s) 113 to the internal circuitry of the vaporizer device 100 are separated from a part of the sensor(s) 113 exposed to the airflow path. In an example of a cartridge-based vaporizer, the seal 150 may also separate parts of one or more electrical connections between a vaporizer body 110 and a vaporizer cartridge 120. Such arrangements of a seal 150 in a vaporizer device 100 can be helpful in mitigating against potentially disruptive impacts on vaporizer components resulting from interactions with environmental factors such as water in the vapor or liquid phases, other fluids such as the vaporizable material 102, etc. and/or to reduce escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, excess vaporizable material 102, etc. in parts of the vaporizer where they may result in poor pressure signal, degradation of the sensor(s) or other components, and/or a shorter life of the vaporizer device 100. Leaks in the seal 150 can also result in a user inhaling air that has passed over parts of the vaporizer device 100 containing or constructed of materials that may not be desirable to be inhaled.

In some implementations, a vaporizer body 110 includes a controller 104, a power source 112 (e.g., battery), one more sensors 113, charging contacts, (e.g., for charging the power source 112), a seal 150, and a cartridge receptacle 118 configured to receive a vaporizer cartridge 120 for coupling with the vaporizer body 110 through one or more of a variety of attachment structures. In some examples, the vaporizer cartridge 120 includes a reservoir 140 for containing a liquid vaporizable material 102, and a mouthpiece 130 having an aerosol outlet for delivering an inhalable dose to a user. The vaporizer cartridge 120 can include an atomizer 141 having a wicking element and a heating element, or alternatively, one or both of the wicking element and the heating element can be part of the vaporizer body 110. In implementations in which any part of the atomizer 141 (e.g., heating element and/or wicking element) is part of the vaporizer body 110, the vaporizer device 100 can be configured to supply liquid vaporizable material 102 from a reservoir 140 in the vaporizer cartridge 120 to the part(s) of the atomizer 141 included in the vaporizer body 110.

Cartridge-based configurations for the vaporizer device 100 that generate an inhalable dose of a vaporizable material 102 that is not a liquid, via heating of a non-liquid material, are also within the scope of the current subject matter. For example, the vaporizer cartridge 120 can include a mass of a plant material that is processed and formed to have direct contact with parts of one or more resistive heating elements, and the vaporizer cartridge 120 can be configured to be coupled mechanically and/or electrically to the vaporizer body 110 that includes the controller 104, the power source 112, and one or more receptacle contacts 125*a* and 125*b* configured to connect to one or more corresponding cartridge contacts 124*a* and 124*b* and complete a circuit with the one or more resistive heating elements.

In an embodiment of the vaporizer device 100 in which the power source 112 is part of the vaporizer body 110, and a heating element is disposed in the vaporizer cartridge 120 and configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element (for example, a heating element within the atomizer 141). These features can include one or more contacts (referred to herein as cartridge contacts 124*a* and 124*b*) on a bottom surface of the vaporizer cartridge 120 and at least two contacts (referred to herein as receptacle contacts 125*a* and 125*b*) disposed near a base of the cartridge receptacle 118 of the vaporizer device 100 such that the cartridge contacts 124*a* and 124*b* and the receptacle contacts 125*a* and 125*b* make electrical connections when the vaporizer cartridge 120 is inserted into and coupled with the cartridge receptacle 118. The circuit completed by these electrical connections can allow delivery of electrical current to a heating element and can further be used for additional functions, such as measuring a resistance of the heating element for use in determining and/or controlling a temperature of the heating element based on a thermal coefficient of resistivity of the heating element.

In some implementations of the current subject matter, the cartridge contacts 124*a* and 124*b* and the receptacle contacts 125*a* and 125*b* can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) such that the cartridge contact 124*a* is electrically connected to the receptacle contact 125*a* and the cartridge contact 124*b* is electrically connected to the receptacle contact 125*b*. Furthermore, the one or more circuits necessary for operation of the vaporizer device 100 can be completed by insertion of the vaporizer cartridge 120 in the cartridge receptacle 118 in a second rotational orientation such cartridge contact 124*a* is electrically connected to the receptacle contact 125*b* and cartridge contact 124*b* is electrically connected to the receptacle contact 125*a*.

In one example of an attachment structure for coupling the vaporizer cartridge 120 to the vaporizer body 110, the vaporizer body 110 includes one or more detents (for example, dimples, protrusions, etc.) protruding inwardly from an inner surface of the cartridge receptacle 118, additional material (such as metal, plastic, etc.) formed to include a portion protruding into the cartridge receptacle 118, and/or the like. One or more exterior surfaces of the vaporizer cartridge 120 can include corresponding recesses (not shown in FIG. 1A) that can fit and/or otherwise snap over such detents or protruding portions when the vaporizer cartridge 120 is inserted into the cartridge receptacle 118 on the vaporizer body 110. When the vaporizer cartridge 120 and the vaporizer body 110 are coupled (e.g., by insertion of the vaporizer cartridge 120 into the cartridge receptacle 118 of the vaporizer body 110), the detents or protrusions of the vaporizer body 110 can fit within and/or otherwise be held within the recesses of the vaporizer cartridge 120, to hold the vaporizer cartridge 120 in place when assembled. Such an assembly can provide enough support to hold the vaporizer cartridge 120 in place to ensure good contact between the cartridge contacts 124*a* and 124*b* and the receptacle contacts 125*a* and 125*b*, while allowing release of the vaporizer cartridge 120 from the vaporizer body 110 when a user pulls with reasonable force on the vaporizer cartridge 120 to disengage the vaporizer cartridge 120 from the cartridge receptacle 118.

In some implementations, the vaporizer cartridge 120, or at least an insertable end 122 of the vaporizer cartridge 120 configured for insertion in the cartridge receptacle 118, can have a non-circular cross section transverse to the axis along which the vaporizer cartridge 120 is inserted into the cartridge receptacle 118. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The cartridge contacts 124*a* and 124*b* and the receptacle contacts 125*a* and 125*b* can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

Figure 1B:
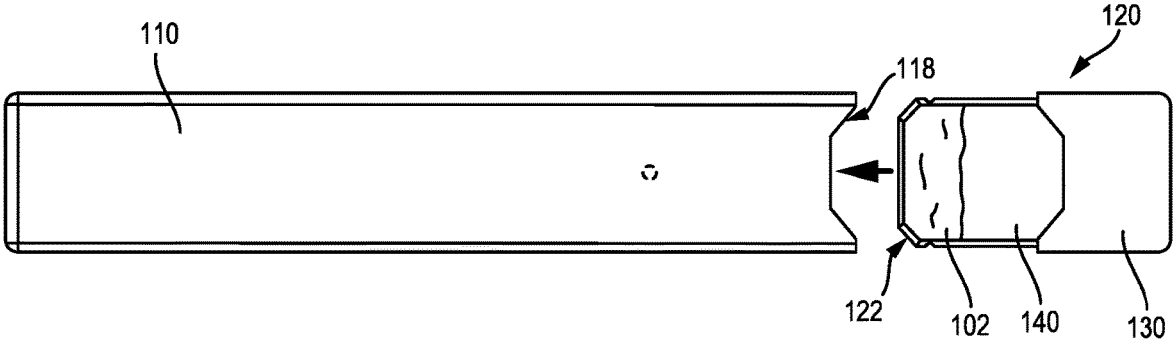
FIG. 1B is a schematic representation of a vaporizer device and vaporizer cartridge.

FIG. 1B illustrates an embodiment of a vaporizer body 110 having a cartridge receptacle 118 into which the vaporizer cartridge 120 may be releasably inserted. FIG. 1B shows a top view of a vaporizer device 100 illustrating the vaporizer cartridge 120 positioned for insertion into the vaporizer body 110. When a user puffs on the vaporizer device 100, air may pass between an outer surface of the vaporizer cartridge 120 and an inner surface of a cartridge receptacle 118 on the vaporizer body 110. Air can then be drawn into an insertable end 122 of the cartridge, through the vaporization chamber that includes or contains the heating element and wick, and out through an outlet of the mouthpiece 130 for delivery of the inhalable aerosol to a user. The reservoir 140 of the vaporizer cartridge 120 may be formed in whole or in part from translucent material such that a level of vaporizable material 102 is visible within the vaporizer cartridge 120. The mouthpiece 130 can be a separable component of the vaporizer cartridge 120 or may be integrally formed with other component(s) of the vaporizer cartridge 120 (e.g., formed as a unitary structure with the reservoir 140 and/or the like). The vaporizer cartridge 120 can also include a cannula running through the reservoir 140 from the atomizer 141 to the mouthpiece 130 of the vaporizer cartridge 120. Air can flow into the vaporizer cartridge 120, through the cannula, and out the mouthpiece 130 to the user. In some embodiments, the vaporizer cartridge 120 can include a gasket configured to provide a seal between the atomizer 141 and the reservoir 140 and the cannula. Additionally and/or alternatively, the cannula can be in fluid communication with the atomizer 141 and a condensation chamber, to deliver the vaporizable material 102 from the atomizer 141 to the condensation chamber. The condensation chamber can be in fluid communication with the atomizer 141, and configured to generate an aerosol from the vaporizable material 102.

Further to the discussion above regarding the electrical connections between a vaporizer cartridge 120 and a vaporizer body 110 being reversible such that at least two rotational orientations of the vaporizer cartridge 120 in the cartridge receptacle 118 are possible, in some vaporizer devices, the shape of the vaporizer cartridge 120, or at least a shape of the end of the vaporizer cartridge 120 that is configured for insertion into the cartridge receptacle 118, may have rotational symmetry of at least order two. In other words, the vaporizer cartridge 120 or at least an insertable end 122 of the vaporizer cartridge 120 may be symmetrical upon a rotation of 180° around an axis along which the vaporizer cartridge 120 is inserted into the cartridge receptacle 118. In such a configuration, the circuitry of the vaporizer device 100 may support identical operation regardless of which symmetrical orientation of the vaporizer cartridge 120 occurs.

Figure 1C:
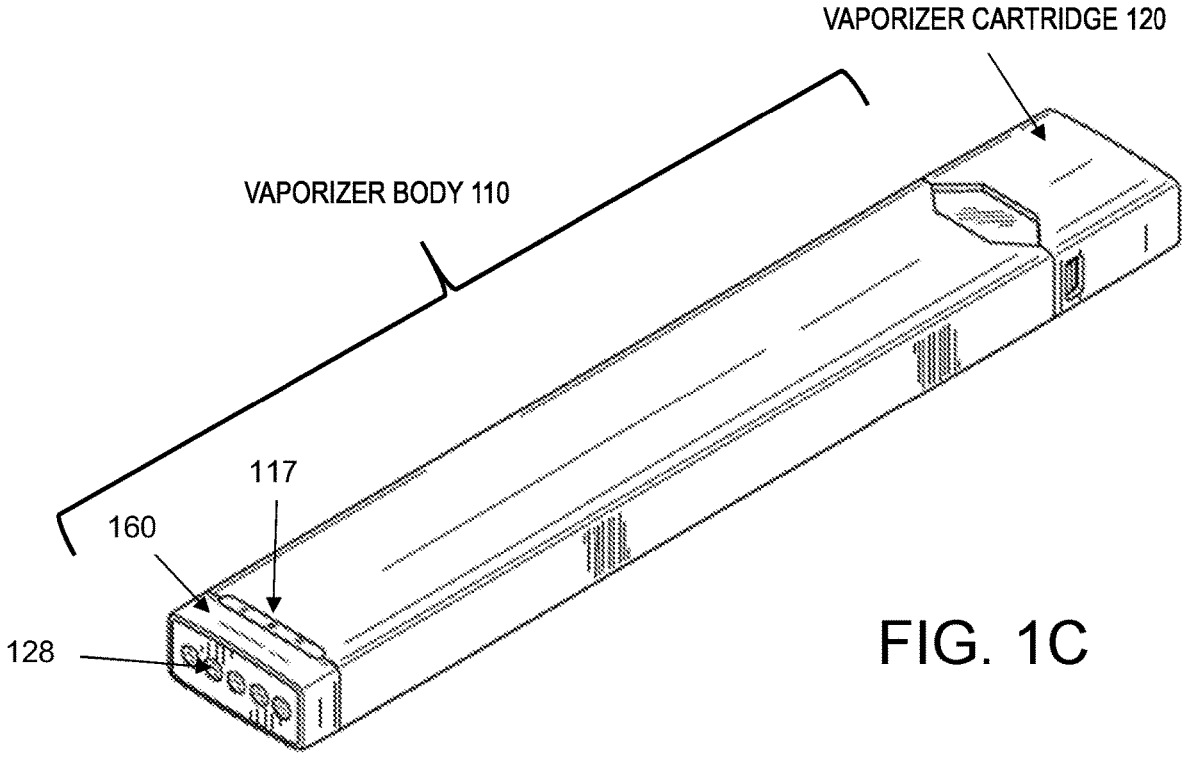
FIG. 1C is a perspective view of another embodiment of a vaporizer cartridge coupled to a vaporizer device.

FIG. 1C shows a perspective view of another example of a vaporizer device 100 including a vaporizer body 110 coupled to a separable vaporizer cartridge 120. As illustrated, the vaporizer device 100 can include one or more outputs 117 (e.g., LEDs) configured to provide information to a user based on a status, mode of operation, and/or the like, of the vaporizer device 100. In some aspects, the one or more outputs 117 can include a plurality of LEDs (e.g., two, three, four, five, or six LEDs). The one or more outputs 117 (e.g., each individual LED) can be configured to display light in one or more colors (e.g., white, red, blue, green, yellow etc.). The one or more outputs 117 can be configured to display different light patterns (e.g., by illuminating specific LEDs, varying a light intensity of one or more of the LEDs over time, illuminating one or more LEDs with a different color, and/or the like) to indicate different statuses, modes of operation, and/or the like of the vaporizer device 100. In some implementations, the one or more outputs 117 can be proximal to and/or at least partially disposed within a bottom end region 160 of the vaporizer device 100. The vaporizer device 100 may, additionally or alternatively, include externally accessible charging contacts 128, which can be proximate to and/or at least partially disposed within the bottom end region 160 of the vaporizer device 100.

Figure 2A:
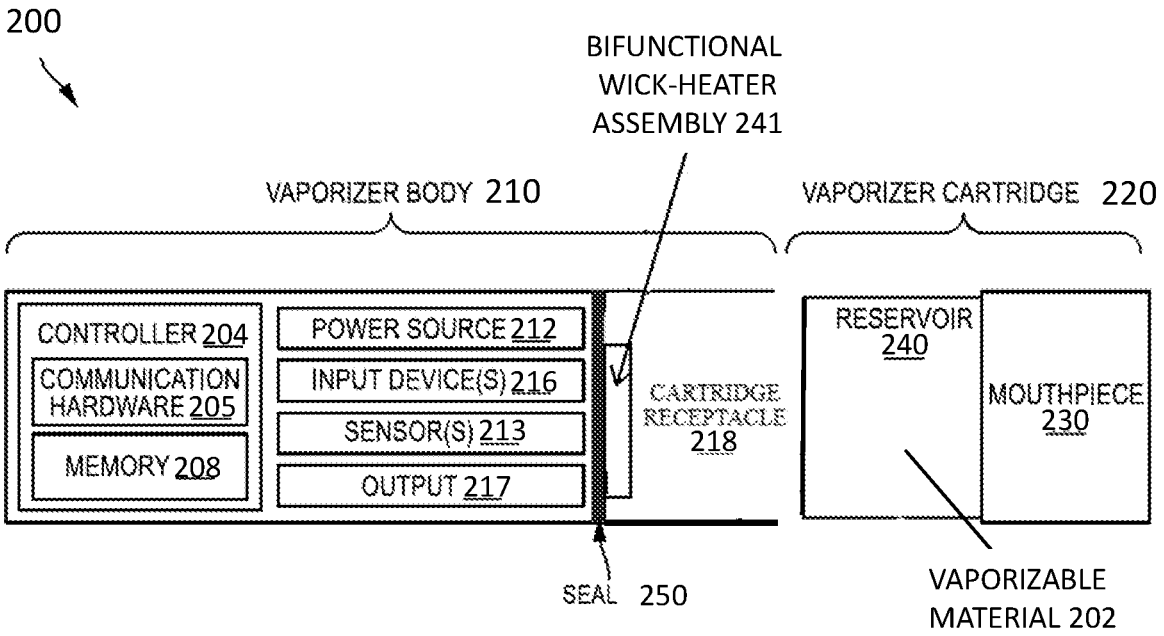
FIG. 2A is a block diagram of a vaporizer device consistent with implementations of the current subject matter, including a vaporizer device and a cartridge.

Referring to the block diagram of FIG. 2A, a vaporizer system 200 can include a vaporizer cartridge 220 and a vaporizer body 210 containing an organic bifunctional wick-heater assembly 241. The vaporizer body 210 can include a cartridge receptacle 218 configured to receive the vaporizer cartridge 220 for coupling with the vaporizer through one or more of a variety of attachment structures. In some examples, the vaporizer cartridge 220 includes a reservoir 240 for containing a liquid vaporizable material and a mouthpiece 230 for delivering an inhalable dose to a user. In some embodiments, the vaporizer body 210 includes a power source 212 (such as a battery which may be a rechargeable battery), and a controller 204 (e.g., a processor, circuitry, etc. capable of executing logic) for controlling delivery of heat produced by the organic bifunctional wick-heater assembly 241 to cause a vaporizable material to be converted from a condensed form (e.g., a solid, a liquid, a solution, a suspension, a part of an at least partially unprocessed plant material, etc.) to the gas phase. The controller 204 may be part of one or more printed circuit boards (PCBs) consistent with certain implementations of the current subject matter.

Using the organic bifunctional wick-heater assembly 241 simplifies the design of the vaporizer system 200. This simplified design can simplify the manufacturing process, and may increase the energy efficiency of the vaporizer system 200. The porous organic substrate can also be made partially porous with sealed faces or solid sections, allowing direct contact between the organic bifunctional wick-heater assembly 241 and the vaporizer body 210, and reducing the time and cost of manufacturing in comparison to manufacturing a heating coil. The size of the organic bifunctional wick-heater assembly 241 can be reduced significantly compared to a traditional fiber wick and heating coil assembly. This can allow more vaporizable material 202 to be contained within the reservoir 240. Additionally and/or alternatively, this can allow for a reduction in the size of the vaporizer system 200. The reduced size of the organic bifunctional wick-heater assembly 241 can also increase the energy efficiency of the vaporizer system 200 by heating the entirety of the porous organic substrate, which is filled with vaporizable material 202. In traditional fiber wick and heating coil configurations, vaporization occurs only at the portions of the fiber wick that are in contact with the heating coil. Using an organic bifunctional wick-heater assembly 241, which has a higher surface area than a traditional wick, can allow a lower operating temperature and thus a reduction in HPHC (harmful and potentially harmful constituents) byproduct generated. A lower operating temperature can be achieved via increased vaporization and energy efficiency. This can also allow longer battery life and a potential reduction in the size of the vaporizer system 200. Additionally and/or alternatively, the vaporizer system 200 having the organic bifunctional wick-heater assembly 241 located within the vaporizer body 210 can allow for a vaporizer cartridge 220 with no electrical components. A vaporizer cartridge 220 without electrical components may have increased recyclability and/or decreased environmental impact. For example, the vaporizer cartridge 220 and/or the mouthpiece 230 may comprise biodegradable materials, recyclable materials, post-consumer recycled materials, or the like, thereby reducing environmental impact when disposing of the vaporizer cartridge 220.

Figure 2B:
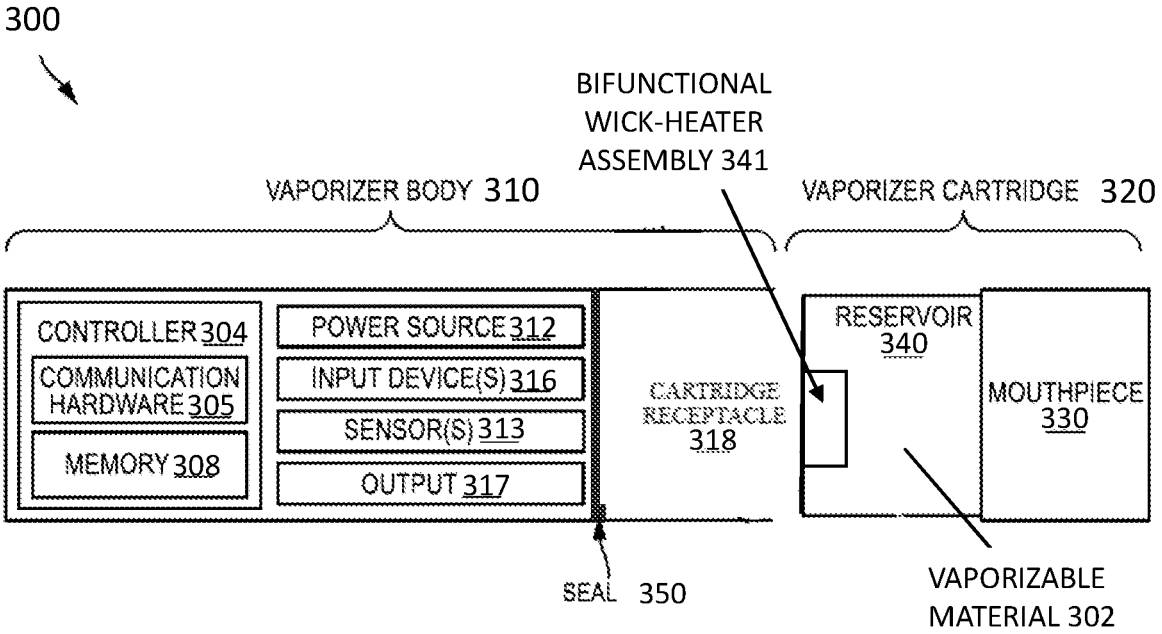
FIG. 2B is a block diagram of a vaporizer device consistent with implementations of the current subject matter, including a vaporizer device and a cartridge.

Referring to the block diagram of FIG. 2B, in some embodiments a vaporizer system 300 can include a vaporizer body 310 and a vaporizer cartridge 320 containing an organic bifunctional wick-heater assembly 341. The vaporizer body 310 can include a cartridge receptacle 318 configured to receive the vaporizer cartridge 320 for coupling with the vaporizer through one or more of a variety of attachment structures. In some examples, the vaporizer cartridge 320 includes a reservoir 340 for containing a liquid vaporizable material, an organic bifunctional wick-heater assembly 341, and a mouthpiece 330 for delivering an inhalable dose to a user. In some embodiments, the vaporizer body 310 includes a power source 312 (such as a battery which may be a rechargeable battery), and a controller 304 (e.g., a processor, circuitry, etc. capable of executing logic) for controlling delivery of heat to the organic bifunctional wick-heater assembly 341 to cause a vaporizable material to be converted from a condensed form (e.g., a solid, a liquid, a solution, a suspension, a part of an at least partially unprocessed plant material, etc.) to the gas phase. The controller 304 may be part of one or more printed circuit boards (PCBs) consistent with certain implementations of the current subject matter.

In the embodiment represented by the block diagram of FIG. 2B, as in the embodiment represented by the block diagram of FIG. 2A, using a bifunctional wick-heater assembly 341 comprising porous organic substrate simplifies the design of the vaporizer system 300, and may increase the energy efficiency of the vaporizer system 300 and decrease the size of the vaporizer body 310. The porous organic substrate can also be partially porous with sealed faces or solid sections, allowing direct contact between the organic bifunctional wick-heater assembly 341 and the vaporizer cartridge 320, as well as reducing the time and cost of manufacturing in comparison to manufacturing a heating coil. In some embodiments, the bifunctional wick-heater assembly 341 may be in contact with the heating element via simple physical connection, thereby simplifying the design of the vaporizer cartridge 320 and further simplifying the manufacturing process. The size of the organic bifunctional wick-heater assembly 341 can be reduced significantly compared to a traditional fiber wick and heating coil assembly. The reduced size of the organic bifunctional wick-heater assembly 341 can increase the energy efficiency of the vaporizer system 300 by heating the entirety of the porous metal, which is filled with vaporizable material 302. As described in the previous embodiment, using an organic bifunctional wick-heater assembly 341 with a higher surface area than a traditional wick can allow a lower operating temperature and thus a reduction in HPHC byproduct generated.

The organic bifunctional wick-heater assembly 241 can comprise a porous organic substrate, and function as both a heater and wick. A porous organic substrate or material provides surface area that is orders of magnitude higher than a traditional fiber wick and heating coil configuration. This increased surface area can increase vaporization efficiency and vapor quantity or Total Particulate Matter (TPM) delivered to a user. Using an organic bifunctional wick-heater assembly 241, where the wick is a heater itself, minimizes the temperature gradient within the organic bifunctional wick-heater assembly 241, thus generating consistent and reliable increased TPM.

By using a porous organic substrate with a controlled pore size, the replenish rate or wicking efficiency of the organic bifunctional wick-heater assembly 241 can be maximized. The replenish rate is largely dependent on the capillary pressure, defined in part by pore size and porosity of the porous organic substrate, and the viscosity of the vaporizable material 202 at an operating temperature. In embodiments, the pore size is between about 50 nm to about 150 nm. Preferably, the pore size is about 100 nm. The porous organic substrate can also reduce the potential issues around leakage of vaporizable material 202 out of the reservoir 240. A porous organic substrate can impede the flow of vaporizable material 202 at room temperature. During use, when the porous organic substrate reaches an operating temperature, the viscosity of the vaporizable material 202 will be lower, allowing easy flow of vaporizable material 202 into the organic bifunctional wick-heater assembly 241. This can create a self-regulated leak prevention system.

Figure 3A:
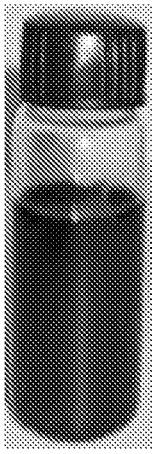
FIG. 3A is a photographic representation graphene oxide gel prepared by modified Hummer's method, consistent with implementations of the current subject matter.
Figure 3B:
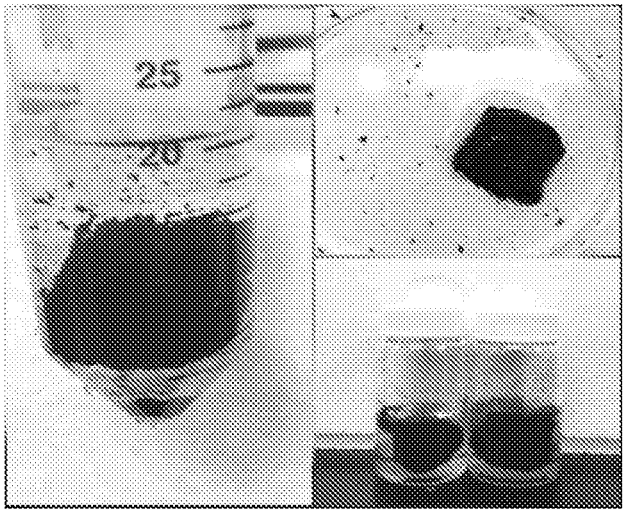
FIG. 3B is photograph of materials for preparing organic bifunctional wick-heater assembly consistent with implementations of the current subject matter, after thermal treatment.
Figure 3C:
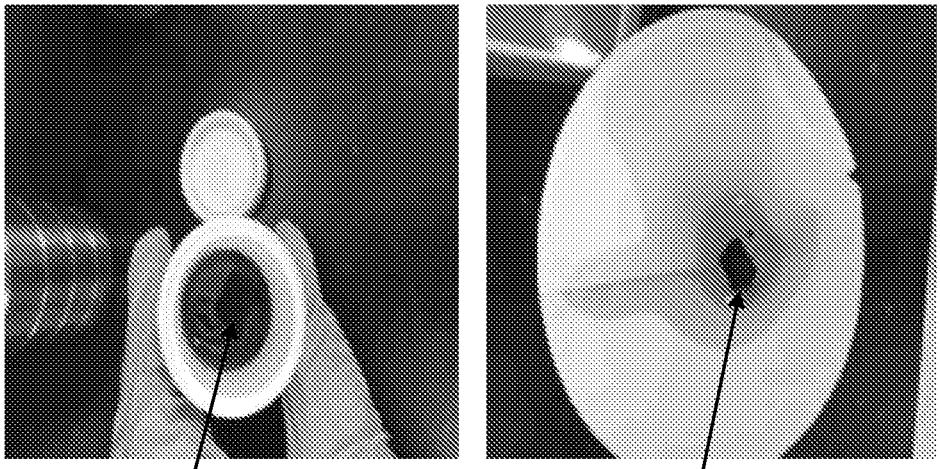
FIG. 3C is photograph of materials for preparing the organic bifunctional wick-heater assembly of FIG. 3B, in the thermal treatment vial (left) and collected in filter paper (right).

FIGS. 3A-3C illustrate an example method of preparing an organic bifunctional wick-heater assembly 241, such as a 3D porous graphene aerogel. In embodiments, a silica aerogel may be used. First, as shown in FIG. 3A, a vial of graphene oxide gel is prepared, the graphene oxide gel having been synthesized by a modified Hummer's method. Hummer's method is a chemical process that can be used to generate graphite oxide through addition of potassium permanganate to a solution of graphite, sodium nitrate, and sulfuric acid. The Hummer's method was modified to increase the oxidation rate by adding acid mixtures. Next, as shown in FIG. 3B, the resulting graphene hydrogel can be placed inside an autoclave vessel for thermal treatment, for example heating at 180 degrees Celsius for 12 hours. As shown in FIG. 3C, the organic bifunctional wick-heater assembly 341 can then be collected from the autoclave in an autoclave vial (left panel) and placed on filter paper (right panel) after thermal treatment. The duration of thermal treatment may range from about 8 to about 24 hours. For example, the time of thermal treatment may be 8, 12, 16, 20, or 24 hours. Finally, the cylindrical shape of the prepared organic bifunctional wick-heater assembly 341 can be confirmed.

Figure 4:
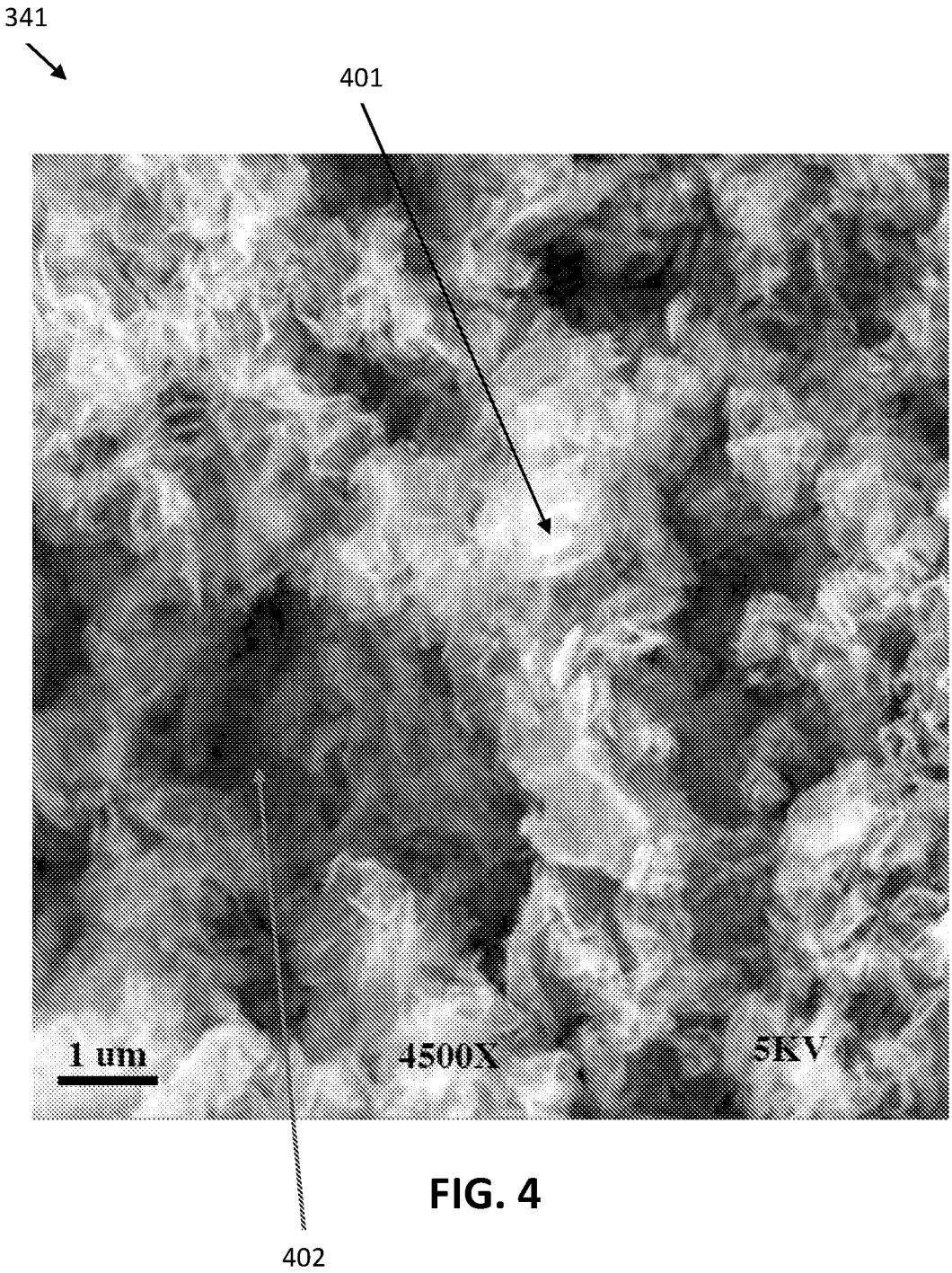
FIG. 4 shows a scanning electron microscopy (SEM) image of an embodiment of an organic bifunctional wick-heater assembly consistent with implementations of the current subject matter.

FIG. 4 shows an SEM image of a modified graphene aerogel 401 for use in an organic bifunctional wick-heater assembly 341, prepared according to the method of FIGS. 3A-3C. The image is shown at 4500× magnification to illustrate the porosity of the modified graphene aerogel 401. As shown in FIG. 4, the modified graphene aerogel 401 includes at least one pore 402. The method shown in FIGS. 3A-3C used to synthesize the modified graphene aerogel 401 is a self-assembly hydrothermal method. The overall shape of the modified graphene aerogel 401 when it comes out of the autoclave is mostly cylindrical, which is an ideal shape for the organic bifunctional wick-heater assembly 241. As stated above, the average size of the at least one pore 402 can be between about 50 nm to about 150 nm, and preferably about 100 nm.

Organic-based aerogel, such as modified graphene aerogel 401, works well as a porous network conductor that can also act as a heater. The combination of porous characteristics and conductivity is a rare combination of physiochemical properties that can be exploited for use in a wick and heater configuration such as the organic bifunctional wick-heater assembly 241. Additionally, and/or alternatively, thermoplastic elastomers, polymers, and epoxies can be used to improve the mechanical strength of graphene, such as for example polypropylene (PP), polyvinyl alcohol (PVA), poly(3,4-ethylenedioxythiophene) (PEDOT), polyurethane (PU), and poly(methylmethacrylate) (PMMA). PMMA has shown the most promising mechanical strength increases among the polymers tested. Testing was performed by applying known loads on top of synthesized aerogels and observing the elastic recovery from the loading.

In some embodiments, the bifunctional wick-heater assembly 341 can be configured as a porous organic substrate positioned between bus bars. For example, two large side bus bars can be positioned opposite each other, with a porous section of organic-based material positioned at least partially between the side bus bars. In some embodiments, the first bus bars can comprise a coated metal, such as brass coated with gold. In embodiments, the bus bars are connected to the porous section via welding, brazing, or similar attachment mechanism. The porous section can be configured to contain vaporizable material and can be an active area that heats during operation due to increased resistance. The porous section may comprise porous organic-based polymers and/or aerogels, such as graphene aerogel, or alloys containing organic-based polymers and/or aerogels. In some embodiments, the porous section may be in contact with the bus bars via simple physical contact, thereby simplifying the design and reducing the manufacturing complexity of the bifunctional wick-heater assembly 341 as compared to a traditional wick. Electrical current can flow across the porous section. In some embodiments, an airflow cutout can be machine formed at the center of the porous section. The airflow cutout can allow unimpeded airflow to the user. The large difference in resistance between the porous section and the solid sections of the bus bars can reduce energy loss and can concentrate heat in the areas of the bifunctional wick-heater assembly 341 in fluid contact with the vaporizable material 302. This reduced energy loss may also contribute to a lower operating temperature and/or longer battery life of the vaporizer system 300.

By using a porous organic substrate with a controlled pore size, the replenish rate or wicking efficiency of the organic bifunctional wick-heater assembly 341 can be maximized. The replenish rate is largely dependent on the capillary pressure, defined in part by pore size and porosity of the porous organic substrate, and the viscosity of the vaporizable material 302 at an operating temperature. In embodiments, the pore size is less than 150 nm. Preferably, the pore size is about 100 nm. The porous organic substrate can also reduce the potential issues around leakage of vaporizable material 302 out of the reservoir 340. A porous organic substrate can impede the flow of vaporizable material 302 at room temperature, when the vaporizable material 302 is too viscous to pass through the porous organic substrate. During use, when the porous organic substrate reaches an operating temperature, the viscosity of the vaporizable material 302 will be lower, allowing easy flow of vaporizable material 202 into the organic bifunctional wick-heater assembly 341. This can create a self-regulated leak prevention system.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on," herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and sub-combinations of the disclosed features and/or combinations and sub-combinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A cartridge for a vaporizer device, the cartridge comprising:

a reservoir configured to contain a vaporizable material; and an atomizer configured to vaporize the vaporizable material, the atomizer comprising a porous organic substrate configured to draw the vaporizable material from the reservoir, the porous organic substrate further configured to receive an electrical current to vaporize the vaporizable material, wherein the porous organic substrate comprises a graphene and polymer aerogel.

2. The cartridge of claim 1, further comprising:

a condensation chamber in fluid communication with the atomizer and configured to generate an aerosol from the vaporizable material.

3. The cartridge of claim 2, wherein the porous organic substrate includes an air channel disposed therethrough to provide air to the condensation chamber.

4. The cartridge of claim 2, further comprising:

a cannula in fluid communication with the atomizer and the condensation chamber to deliver the vaporizable material from the atomizer to the condensation chamber.

5. The cartridge of claim 1, further comprising:

a mouthpiece configured to deliver the aerosol to a user.

6. The cartridge of claim 1, further comprising:

a first bus bar and a second bus bar, the first bus bar disposed at a first end of the porous organic substrate and the second bus bar disposed at a second end of the porous organic substrate.

7. The cartridge of claim 1, wherein the cartridge comprises an air channel disposed proximate to the porous organic substrate.

8. The cartridge of claim 1, further comprising:

a first air inlet in fluid communication with the atomizer, the first air inlet configured to deliver air to the atomizer.

9. The cartridge of claim 1, further comprising:

a second air inlet in fluid communication with the atomizer, the second air inlet configured to deliver air to the atomizer.

10. The cartridge of claim 1, wherein the porous organic substrate comprises a plurality of fluid channels configured to provide fluid flow of the vaporizable material.

11. The cartridge of claim 1, wherein the porous organic substrate has an average pore size diameter from about 5 microns to about 50 microns.

12. The cartridge of claim 1, wherein the porous organic substrate comprises a surface treatment.

13. The cartridge of claim 1, further comprising the vaporizable material.

14. The cartridge of claim 13, wherein the vaporizable material comprises a nicotine formulation.

15. The cartridge of claim 13, wherein the vaporizable material comprises a humectant including propylene glycol, vegetable glycerin, or combinations thereof.

16. The cartridge of claim 13, wherein the vaporizable material comprises a nicotine salt formulation.

17. The cartridge of claim 1, wherein the porous organic substrate has a resistivity of about 0.5 to about 2.0 ohm-cm.

18. A vaporizer device comprising a receptacle configured to receive the cartridge of claim 1.

19. A cartridge for a vaporizer device, the cartridge comprising:

a reservoir configured to contain a vaporizable material;

an atomizer configured to vaporize the vaporizable material, the atomizer comprising a porous organic substrate configured to draw the vaporizable material from the reservoir, the porous organic substrate further configured to receive an electrical current to vaporize the vaporizable material; and a condensation chamber in fluid communication with the atomizer and configured to generate an aerosol from the vaporizable material, wherein the porous organic substrate includes an air channel disposed therethrough to provide air to the condensation chamber.

20. A cartridge for a vaporizer device, the cartridge comprising:

a reservoir configured to contain a vaporizable material; and an atomizer configured to vaporize the vaporizable material, the atomizer comprising a porous organic substrate configured to draw the vaporizable material from the reservoir, the porous organic substrate further configured to receive an electrical current to vaporize the vaporizable material, wherein the porous organic substrate has a resistivity of about 0.5 to about 2.0 ohm-cm.

21. A cartridge for a vaporizer device, the cartridge comprising:

a reservoir configured to contain a vaporizable material; and an atomizer configured to vaporize the vaporizable material, the atomizer comprising a porous organic substrate configured to draw the vaporizable material from the reservoir, the porous organic substrate further configured to receive an electrical current to vaporize the vaporizable material; and a first bus bar and a second bus bar, the first bus bar disposed at a first end of the porous organic substrate and the second bus bar disposed at a second end of the porous organic substrate, wherein the first bus bar comprises a first cartridge contract and the second bus bar comprises a second cartridge contact.

22. The cartridge of claim 21, wherein the porous organic substrate comprises at least one of a graphene material or a polymer.

23. The cartridge of claim 22, wherein the polymer is polymethylmethacrylate.

* * * * *